US006516177B2

(12) United States Patent
Nagafuji

(10) Patent No.: US 6,516,177 B2
(45) Date of Patent: Feb. 4, 2003

(54) FIXING APPARATUS AND IMAGE FORMING APPARATUS USING THE FIXING APPARATUS

(75) Inventor: Hideo Nagafuji, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/984,373

(22) Filed: Oct. 30, 2001

(65) Prior Publication Data

US 2002/0051662 A1 May 2, 2002

(30) Foreign Application Priority Data

Oct. 30, 2000 (JP) ..... 2000-331066

(51) Int. Cl.[7] ..... G03G 15/20

(52) U.S. Cl. ..... 399/330; 219/469; 399/335; 492/46; 492/47

(58) Field of Search ..... 399/330, 331, 399/333, 335; 219/216, 469, 470; 492/46, 47

(56) References Cited

U.S. PATENT DOCUMENTS 4,158,128 A * 6/1979 Evdokimov et al. ..... 219/469
4,348,579 A * 9/1982 Namba ..... 399/330 X
4,645,327 A * 2/1987 Kimura et al. ..... 219/216 X
4,942,434 A * 7/1990 Nakai et al. ..... 399/331
5,802,443 A 9/1998 Matsumoto et al. ..... 399/333

FOREIGN PATENT DOCUMENTS

| | | | |
|---|---|---|---|
| JP | 10-39665 | | 2/1998 |
| JP | 11-149226 | * | 6/1999 |
| JP | 2000-29342 | | 1/2000 |
| JP | 2001-109306 | | 4/2001 |

* cited by examiner

*Primary Examiner*—Fred L. Braun
(74) *Attorney, Agent, or Firm*—Oblon, Spivak, McClelland, Maier & Neustadt, P.C.

(57) ABSTRACT

A fixing apparatus for fixing a toner image onto a recording sheet with heat includes a fixing roller having ribs formed at a sheet passing area in an axial direction thereof so as to protrude from an internal circumferential surface toward a cross-sectional center thereof. The ribs are provided along the axial direction such that a number of ribs per unit length at a center part of the sheet passing area is different from that at other parts of the area. A heating source is provided for heating the fixing roller and a pressing roller opposes and rotates with the fixing roller. The toner image is fixed onto the recording sheet while the sheet is being sandwiched and conveyed between the fixing roller and the heating roller.

28 Claims, 4 Drawing Sheets

FIXING APPARATUS AND IMAGE FORMING APPARATUS USING THE FIXING APPARATUS

BACKGROUND OF THE INVENTION

1. Field of the Invention

The present invention relates to a fixing apparatus for use in an image forming apparatus and an image forming apparatus using the fixing apparatus, and in particular relates to a structure for reinforcing a heating roller of a fixing apparatus.

2. Discussion of the Background

In image forming apparatuses, such as copying machines, facsimile apparatus, printers, printing apparatus, etc., an unfixed toner image transferred onto and carried on a recording medium such as paper is heated by a fixing apparatus to be fixed onto the recording medium, and thereby a reproduced or printed image is obtained on the recording medium.

A background fixing apparatus has a configuration in which a pair of rollers are arranged to oppose each other. One of the rollers is used as a heating roller for heating a recording medium and the other roller is used as a pressing roller for pressing the recording medium against the heating roller. In this configuration, the recording medium is conveyed while being sandwiched between the heating roller and the pressing roller at a nip portion between the heating roller and the pressing roller, and thereby an unfixed toner image carried on the recording medium is fixed onto the recording medium by heat from the heating roller.

In order to accomplish efficient fixing in such a fixing apparatus, it is important to increase heat transmission efficiency of the heating roller by using material having a satisfactory heat conductivity for the heating roller. In addition, the heating roller is generally designed in such a way that the heat conductivity is increased. As an example, a wall thickness of the heating roller is made thin so that the heat capacitance of the heating roller is reduced, thereby enabling shortening the rising time for the heating roller to reach a fixing temperature and reducing the power consumption of the heating roller.

However, when a heating roller is constructed to have a thin wall, the mechanical rigidity of the heating roller is decreased, so that bending may occur in the heating roller or a portion of the heating roller pressed by a pressing roller may be crushed in an axial direction of the heating roller.

In a background construction for avoiding the above-described problem in a heating roller, separate reinforcing members such as rings are arranged to be fixed to internal surfaces of the heating roller at a plurality of positions of the heating roller, e.g., at a center part and end parts of the heating roller in an axial direction thereof, where the heating roller most likely tends to be crushed.

However, the present inventor recognized that in the above-described configuration, the reinforcing rings must be processed separately from the heating roller, thereby causing the cost of the heating roller to increase. In addition, when the heating roller is actually used in an image forming apparatus, the rings may be deformed due to thermal expansion thereof, thereby falling off the internal surfaces of the heating roller. As a result, deformation such as bending or crushing of the heating roller cannot be avoided. If the heating roller is deformed, the force of sandwiching a recording medium with the fixing roller and the pressing roller is decreased, and thereby the efficiency of heating the recording sheet with the heating roller is decreased, and consequently inferior fixing is caused.

Further, the present inventor recognized that when the reinforcing rings are arranged at a plurality of positions of a heating roller in an axial direction thereof, depending upon the number of the rings that are provided, heat loss may be caused by heat dissipation via the reinforcing rings, which may also cause a decrease in the efficiency of heating of the recording medium with the heating roller and consequent inferior fixing.

SUMMARY OF THE INVENTION

The present invention has been made in view of the above-discussed and other problems and addresses the above-discussed and other problems.

Preferred embodiments of the present invention provide a novel fixing apparatus and an image forming apparatus using the fixing apparatus, in which increased processing cost of a heating roller and falling off of reinforcing members for the heating roller are prevented and at the same time the rising time of the fixing apparatus to a fixing temperature can be decreased and inferior fixing is prevented.

According to a preferred embodiment of the present invention, a novel fixing apparatus for fixing a toner image carried on a recording sheet onto the recording sheet with heat includes a fixing roller having a plurality of ribs formed at a sheet passing area of the fixing roller in an axial direction of the fixing roller to protrude from an internal circumferential surface of the fixing roller toward a cross-sectional center thereof. The plurality of ribs are provided along the axial direction of the fixing roller such that a number of ribs per unit length at a center part of the sheet passing area of the fixing roller in the axial direction of the fixing roller is different from that at other parts of the sheet passing area. The fixing apparatus further includes a heating source for heating the fixing roller and a pressing roller opposing and rotating with the fixing roller, and the toner image on the recording sheet is fixed onto the recording sheet while the recording sheet is being sandwiched and conveyed between the fixing roller and the pressing roller.

In the above-described fixing apparatus, the heating source may be provided inside the fixing roller.

Further, the number of ribs per unit length may be greater at the center part of the sheet passing area of the fixing roller in the axial direction of the fixing roller than at the other parts of the sheet passing area.

Furthermore, a center of the fixing roller in the axial direction thereof may correspond to a center of the sheet passing area of the fixing roller in the axial direction of the fixing roller.

Still further, the fixing roller may have a first wall thickness at the sheet passing area thereof and a second wall thickness at least at a part of axial end parts thereof that are out of the sheet passing area. The second wall thickness may be greater than the first wall thickness.

Furthermore, the above-described fixing apparatus may further include a supporting member opposing a part of the axial end parts of the fixing roller to support the fixing roller. In this case, the part of the axial end parts of the fixing roller where the fixing roller supporting member opposes does not have the second wall thickness. Further, a rib may be formed at the part of each of the axial end parts of the fixing roller where one of the fixing roller supporting members is located to protrude from the internal circumferential surface of the fixing roller toward the cross-sectional center thereof. A height from the internal circumferential surface of the fixing roller, of the rib formed at the part of each of the axial end parts of the fixing roller where one of the fixing roller supporting members is located to protrude from the internal circumferential surface of the fixing roller toward the cross-sectional center thereof is different from that of the part of the axial end parts of the fixing roller having the second wall thickness. The height from the internal circumferential surface of the fixing roller, of the rib formed at the part of the axial end parts of the fixing roller where the fixing roller supporting member is located may be equal to that of the plurality of ribs formed at the sheet passing area of the fixing roller.

According to another preferred embodiment of the present invention, an image forming apparatus includes an image forming unit for forming a toner image on a recording sheet and a fixing apparatus for fixing the toner image on the recording sheet onto the recording sheet with heat. The fixing apparatus includes a fixing roller having a plurality of ribs formed at a sheet passing area of the fixing roller in an axial direction of the fixing roller so as to protrude from an internal circumferential surface of the fixing roller toward a cross-sectional center thereof. The plurality of ribs are provided along the axial direction of the fixing roller such that a number of ribs per a unit length at a center part of the sheet passing area of the fixing roller in the axial direction of the fixing roller is different from that at other parts of the sheet passing area. The fixing apparatus further includes a heating source for heating the fixing roller and a pressing roller opposing and rotating with the fixing roller, and the toner image on the recording sheet is fixed onto the recording sheet while the recording sheet is being sandwiched and conveyed between the fixing roller and the pressing roller.

In the above-described image forming apparatus, the heating source may be provided inside of the fixing roller.

Further, the number of ribs per unit length may be greater at the center part of the sheet passing area of the fixing roller in the axial direction of the fixing roller than at the other parts of the sheet passing area.

Furthermore, a center of the fixing roller in the axial direction thereof may correspond to a center of the sheet passing area of the fixing roller in the axial direction of the fixing roller.

Still furthermore, the fixing roller may have a first wall thickness at the sheet passing area thereof and a second wall thickness at least at a part of axial end parts thereof that are out of the sheet passing area. The second wall thickness is greater than the first wall thickness.

Further, in the above-described image forming apparatus, the fixing apparatus may include a supporting member opposing a part of the fixing roller at the axial end parts of the fixing roller to support the fixing roller. In this case, the part of each of the axial end parts of the fixing roller where the fixing roller supporting member is located does not have the second wall thickness.

Further, a rib may be formed at the part of each of the axial end parts of the fixing roller where one of the fixing roller supporting members is located to protrude from the internal circumferential surface of the fixing roller toward the cross-sectional center thereof. In this case, a height from the internal circumferential surface of the fixing roller, of the rib formed at the part of each of the axial end parts of the fixing roller where the fixing roller supporting member is located to protrude from the internal circumferential surface of the fixing roller toward the cross-sectional center thereof is different from that of the parts of the axial end parts of the fixing roller, having the second wall thickness. The height from the internal circumferential surface of the fixing roller of the rib formed at the part of each of the axial end parts of the fixing roller where one of the fixing roller supporting members is located may be equal to that of the plurality of ribs formed at the sheet passing area of the fixing roller.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
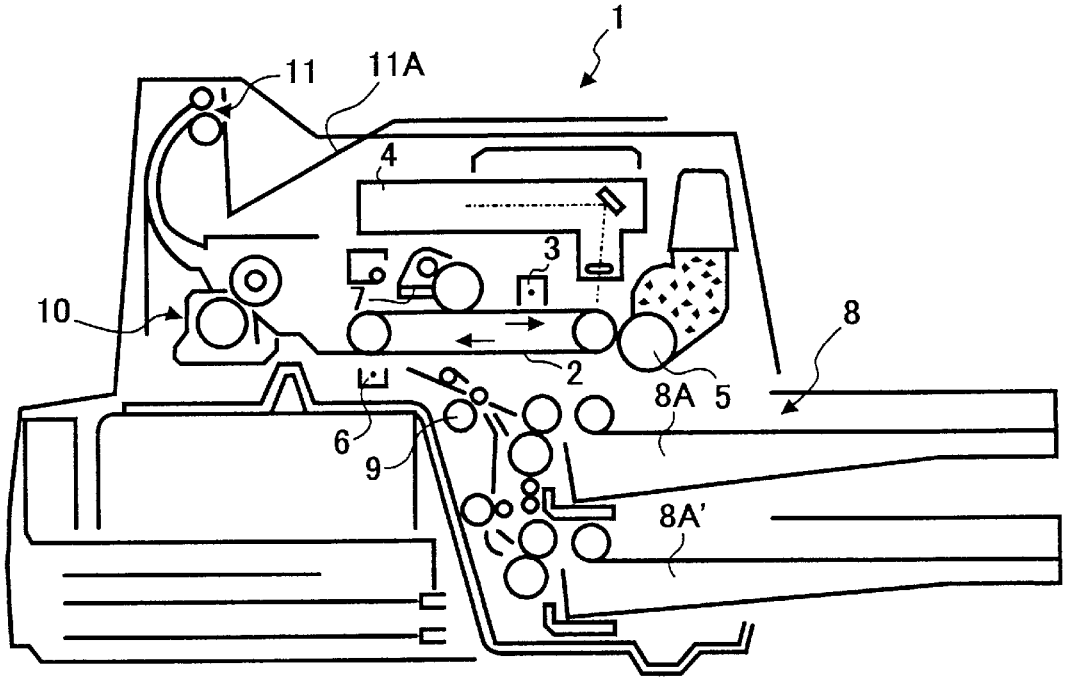
FIG. 1 is a cross-section illustrating a printer as an example of an image forming apparatus having a fixing apparatus according to a preferred embodiment of the present invention.

Referring now to the drawings, wherein like reference numerals designate identical or corresponding parts throughout the several views, preferred embodiments of the present invention are described.

FIG. 1 illustrates a printer as an example of an image forming apparatus having a fixing apparatus according to a preferred embodiment of the present invention.

A printer 1 includes a belt-shaped photoconductor 2 (hereinafter referred to as the photoconductor belt 2). Positioned around the photoconductor belt 2 along a moving direction of the photoconductor belt 2 indicated by arrow in the figure are a charging device 3, a writing device 4 having a laser optical system, a developing device 5, a transfer device 6, and a cleaning device 7.

A sheet feeding device 8, which includes a plurality of feeding cassettes 8A and 8A' accommodating recording sheets of a plurality of sizes and a registration roller 9, is arranged near the transfer device 6. Further, a fixing apparatus 10 is arranged at a position where a recording sheet, onto which an image has been transferred from the photoconductor belt 2 with the transfer device 6, is separated from the photoconductor belt 2 by curvature of the belt 2, and a sheet discharging device 11 is arranged after the fixing apparatus 10 in the recording sheet conveying direction.

The photoconductor belt 2 is uniformly charged by the charging device 3 while moving, and then an electrostatic latent image according to image information is formed on the photoconductor belt 2 by the writing device 4. The latent image is visualized by the developing device 5, and the visualized image is transferred onto a recording sheet conveyed from the feeding device 8 by the transfer device 6.

The recording sheet onto which an image has been transferred is separated from the photoconductor belt 2 by curvature of the belt 2, and reaches the fixing apparatus 10, where the image is fixed onto the recording sheet. The recording sheet is then discharged onto a discharging tray 11A by the discharging device 11.

Figure 2:
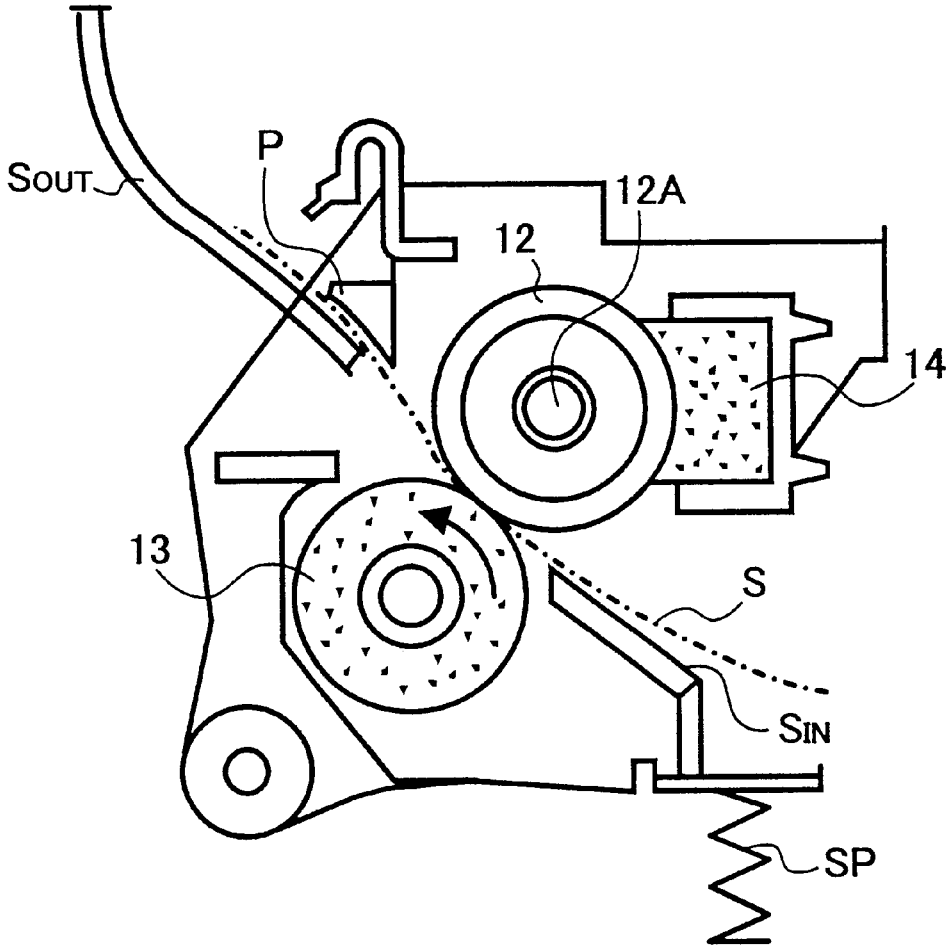
FIG. 2 is a cross-section of the fixing apparatus.

FIG. 2 illustrates the construction of the fixing apparatus 10. In FIG. 2, the fixing apparatus 10 includes a fixing roller 12 including a heating source 12A inside thereof and a pressing roller 13 opposing and contacting the fixing roller 12 so as to rotate together with the fixing roller 12.

The fixing roller 12 is made of material having a satisfactory heat conductivity, such as steel (e.g., STKM11, STKM12) or an aluminum alloy, and offset preventing oil (not shown) is coated on its surface. A cleaning pad 14 is pressed against the fixing roller 12 to remove surplus oil from the fixing roller 12.

The pressing roller 13 may have a diameter of 30 mm. The pressing roller 13 may be configured to have rubber, which is, e.g., 5.5 mm thick and 316 mm long in its axial direction, on its surface, or to be a solid roller without having such rubber. In FIG. 2, reference S denotes a recording sheet carrying an unfixed image thereupon, reference $S_{IN}$ denotes a sheet entrance guide, reference $S_{OUT}$ denotes a sheet exit guide, reference P denotes a separation claw, and reference SP denotes a spring pressing the pressing roller 13 toward the fixing roller 12.

Figure 3:
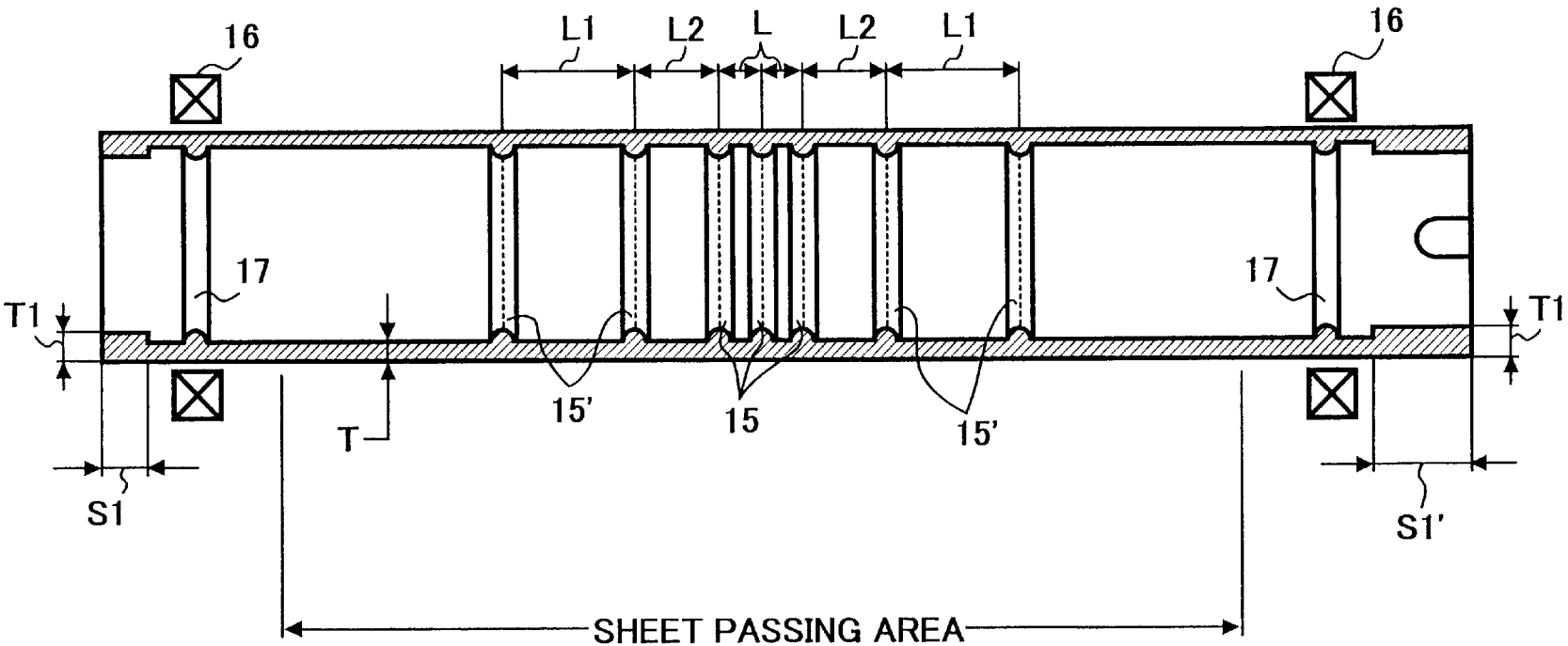
FIG. 3 is a cross-section of a fixing roller of the fixing apparatus.
Figure 5:
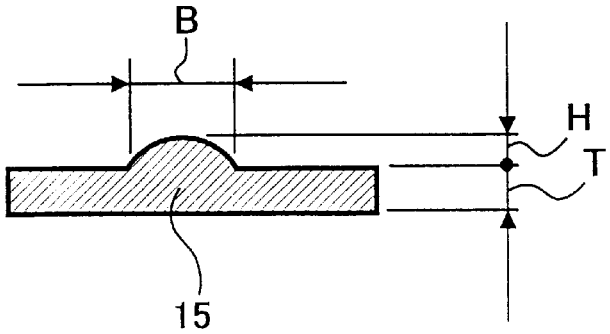
FIG. 5 is a partial cross-section for explaining an internal configuration of both end parts of the fixing roller of FIG. 4 in the axial direction thereof.

The outer diameter of the fixing roller 12 can be set in the range of 16–40 mm, and as illustrated in FIGS. 3 and 5, the wall thickness (T) of the fixing roller 12 can be set in the range of 0.25–0.5 mm, and the length of the fixing roller 12 in its axial direction can be set in the range of 350–410 mm.

The deformation in a fixing roller when the fixing roller and a pressing roller sandwiches and conveys a recording sheet changes according to the outer diameter of the fixing roller. Specifically, when the wall thickness of a fixing roller is the same throughout its length, as the outer diameter of the fixing roller increases, the deformation in the fixing roller increases. In this embodiment, the ratio of the wall thickness relative to the outer diameter of the fixing roller 12 can be set in the range of 8/1000–20/1000. More specifically, when the fixing roller 12 is made of steel (STKM11, STKM12), the ratio of the wall thickness relative to the outer diameter of the fixing roller 12 can be set in a range of 8/1000–14/1000, and when the fixing roller 12 is made of an aluminum alloy, the ratio of the wall thickness relative to the outer diameter of the fixing roller 12 can be set in a range of 12/1000–20/1000. When the ratio is smaller than the above ranges, the deformation of the fixing roller 12 when the fixing roller 12 and the pressing roller 13 sandwiches and conveys a recording sheet is relatively large so that wrinkling tends to occur in the recording sheet, and when the ratio is greater than the above ranges, the rising time for the fixing roller 12 to reach a fixing temperature increases.

In this embodiment, when the fixing roller 12 is made of steel (e.g., STKM12), the outer diameter of the fixing roller 12 can be set to 30 mm, and the wall thickness at a sheet passing area of the fixing roller 12 in the axial direction of the fixing roller 12 (the thickness denoted by T in FIGS. 3 and 5) can be set to 0.3 mm, so that the ratio of the wall thickness relative to the outer diameter of the fixing roller 12 can be set to 10/1000. When the fixing roller 12 is made of an aluminum alloy (e.g., A5052), the outer diameter of the fixing roller 12 can be set to 30 mm, and the wall thickness at the sheet passing area of the fixing roller 12 (the thickness denoted by T in FIGS. 3 and 5) can be set to 0.45 mm, so that the ratio of the wall thickness relative to the outer diameter of the fixing roller 12 is set to 15/1000.

FIG. 3 is a cross-section of the fixing roller 12. As illustrated in FIG. 3, a plurality of ribs 15, 15' are formed in the sheet passing area of the fixing roller 12 in the axial direction thereof, along the axial direction of the fixing roller 12.

The ribs 15, 15' can be formed such that, irrespective of the material of the fixing roller 12, the width (B) in the axial direction of the fixing roller 12 can be set to 1.5–3 mm, and the height (H) from the internal circumferential surface of the fixing roller 12 toward the center of the fixing roller 12 in its cross-section can be set to 0.5 mm, which corresponds to 0.8–2.0 times of the wall thickness at the sheet passing area of the fixing roller 12 (the thickness denoted by T in FIGS. 3 and 5). The ribs 15 provided at the center part of the sheet passing area in the axial direction of the fixing roller 12 are arranged with an interval smaller than that of the ribs 15' provided at other parts of the sheet passing area of the fixing roller 12. That is, the number of ribs per unit length is greater at the center part of the sheet passing area than at the other parts of the sheet passing area of the fixing roller 12. In this embodiment, as illustrated in FIG. 3, the plurality of ribs 15, 15', i.e., three ribs 15 and four ribs 15', are provided such that the interval L of the ribs 15 provided at the center part of the sheet passing area in the axial direction of the fixing roller 12 satisfies a relation: L<L2<L1, where a reference L1 represents an interval of the ribs 15' provided at the other parts of the sheet passing area than the center part thereof and a reference L2 represents an interval between the rib 15 of the center part of the sheet passing area, that is located to face the ribs 15' of the other parts of the sheet passing area, and the ribs 15' of the other area of the sheet passing area, that is located to face the rib 15 of the center part of the sheet passing area.

The fixing roller 12 is configured such that the wall thickness at its axial end parts (the thickness denoted by T1 in FIGS. 3 and 4) is greater than the wall thickness T in the sheet passing area. The wall thickness T1 can be set such that the ratio of the wall thickness TI relative to the outer diameter of the fixing roller 12 can be set in the range of 16/1000–40/1000. In this embodiment, when the fixing roller 12 is made of steel (e.g., STKM12), the wall thickness T1 at the axial end parts can be 0.55 mm, and when the fixing roller 12 is made of an aluminum alloy, the wall thickness T1 at the axial end parts can be 0.9 mm. The reason why the wall thickness differs according to the material of the fixing roller 12 is that the rigidity of the fixing roller 12 differs depending upon the material of the fixing roller 12. In either case, the wall thickness of the fixing roller 12 is determined such that a predetermined cross-sectional rigidity is obtained in the fixing roller 12.

The reason why more ribs 15 are arranged at the center part of the sheet passing area of the fixing roller 12 in the axial direction of the fixing roller 12 than at other parts of the sheet passing area is because that once the cross-sectional rigidity at the both axial end parts of the fixing roller 12 is obtained, then the center part of the sheet passing area of the fixing roller 12 thinner than the both axial end parts thereof is decreased in the sectional rigidity relative to the both axial end parts thereof, so that the center part of the sheet passing area of the fixing roller 12 tends to be crushed. The ribs 15 at the center part of the sheet passing area of the fixing roller 12 prevent the fixing roller 12 from being crushed at the center part thereof, thereby avoiding the force of sandwiching a recording sheet between the fixing roller 12 and the pressing roller 13 from being decreased to cause inferior fixing. In particular, even when fixing a thick recording sheet, e.g., a sheet of 135K, or a recording sheet having an inferior surface smoothness, according to a correlation between the wall thickness of the fixing roller 12 and the number of ribs provided to the fixing roller 12, the fixing roller 12 is prevented from being crushed at the center part thereof, and thereby inferior fixing is avoided.

Thus, because the wall thickness of the fixing roller 12 is smaller at the sheet passing area of the fixing roller 12 in the axial direction of the fixing roller 12 than at the axial end parts of the fixing roller 12, the rising time of the fixing roller 12 to a fixing temperature can be decreased. The decrease in the rigidity of the fixing roller 12 at the center part of the sheet passing area of the fixing roller 12 in the axial direction thereof is reinforced by providing more of the ribs 15 to the center part of the sheet passing area than to the other parts of the sheet passing area of the fixing roller 12.

In the embodiment, the ribs 15, 15' serving as reinforcing members for the fixing roller 12 are formed integrally with the fixing roller 12 so as to protrude from an internal circumferential surface toward a center of the cross-section of the fixing roller 12. Therefore, unlike a structure in which reinforcing rings, which are separate from a fixing roller, are provided inside of the fixing roller, the reinforcing members, i.e., the ribs 15,15', never fall off the internal surface of the fixing roller 12, and thereby deformation of the fixing roller 12 when the fixing roller 12 is heated, such as bending, can be securely prevented. Thus, a decrease in the force of sandwiching a recording sheet at the sheet passing area of the fixing roller 12, which is caused by deformation in the fixing roller 12, is prevented, and thereby the heat transfer or conduction to the recording sheet from the fixing roller 12 can be satisfactorily maintained.

According to a result of a measurement of the rising time of the fixing roller 12 to a 30 fixing temperature according to the above-described embodiment, when the output of a heating source of the fixing roller 12 was about 700–800W, the rising time of the fixing roller 12 to the fixing temperature was about 10–15 sec. This rising time is considerably shorter that of a fixing roller in which the wall thickness of the fixing roller is not changed, as in the above-described embodiment of the present invention, between the sheet passing area and both end parts of the fixing roller.

Now, a fixing apparatus according to another preferred embodiment of the present invention is described.

In the another embodiment, the fixing roller 12 is supported at both end parts thereof by a bearing functioning as a rotation supporting member for the fixing roller 12 as illustrated in FIG. 3. In the embodiment, a ball bearing 16 is used for each of the supporting members for the fixing roller 12. In a high speed image forming apparatus, the linear velocity of a recording sheet is set in the range of about 100–130 mm/sec. Therefore, when the fixing roller 12 is used in such a high speed image forming apparatus, the rotation speed of the fixing roller 12 is set at a relatively high speed, and at the same time the driving torque for the fixing roller 12 must be decreased. Because the ball bearings 16 can avoid giving an excessive load to the fixing roller 12, ball bearings 16 can be advantageously used in such a high speed image forming apparatus.

Each ball bearing 16 is configured to contact an outer circumferential surface of the fixing roller 12 at a part of one of the axial end parts of the fixing roller 12. Therefore, if the wall thickness of the fixing roller 12 at the part of the axial end parts of the fixing roller 12 where the ball bearings 16 are located is substantially the same as that of the axial end parts of the fixing roller 12, which is greater than the sheet passing area of the fixing roller 12, heat may be dissipated through the ball bearings 16 contacting the part of the axial end parts of the fixing roller 12 because of a relatively high heat capacity of that part.

Accordingly, the fixing roller 12 of the present invention is configured such that the above heat dissipation through the ball bearings 16 is prevented. Specifically, the fixing roller 12 is configured such that the wall thickness T1 of both axial end parts of the fixing roller 12 is greater than the wall thickness T of the sheet passing area of the fixing roller 12 except for the part of the axial end parts of the fixing roller 12 where the ball bearings 16 are located.

In this embodiment, as illustrated in FIG. 3, the lengths S1 and S1' of the parts of the axial end parts of the fixing roller 12, having the wall thickness T1 that is greater than the wall thickness T of the sheet passing area of the fixing roller 12, can be set to be in the ranges of 5–10 mm and 12–16 mm from the ends of the fixing roller 12 respectively. These ranges are both smaller than respective distances from the ends of the fixing roller 12 to the parts of the axial end parts of the fixing roller 12 where the ball bearings 16 are located.

Figure 4:
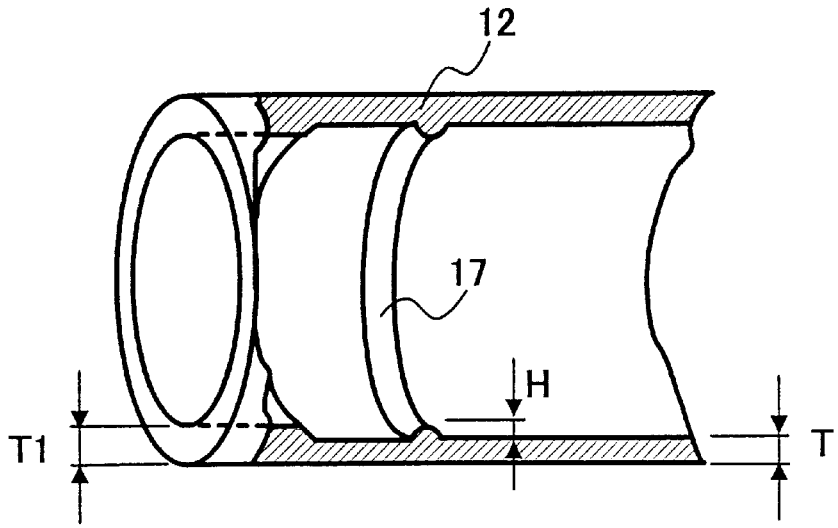
FIG. 4 is a partial perspective view of the fixing roller of FIG. 3.

At each of the parts of the axial end parts of the fixing roller 12 where the ball bearings 16 are located, as illustrated in FIGS. 4 and 5, a rib 17 having a dimension different from that of the part of the axial end parts of the fixing roller 12 having the wall thickness T1 is provided so as to protrude from an internal circumferential surface of the fixing roller 12 toward the center of the cross-section of the fixing roller 12.

In the embodiment, each rib 17 is configured to have the same height (H) from the internal circumferential surface of the fixing roller 12 toward the center of the cross-section of the fixing roller 12 and width (B) in the axial direction of the fixing roller 12 as those of the ribs 15, 15' provided at the sheet passing area of the fixing roller 12.

As described above, both end parts that are thicker than the sheet passing area of the fixing roller 12 do not reach the parts of the fixing roller 12 where the ball bearings 16 are located, respectively. Thus, at each of the parts of the fixing roller 12 where the ball bearing 16 contacts the outer circumferential surface thereof, because the greater wall thickness having a relatively large heat capacity is not present, heat conduction at that part is reduced and thereby heat dissipation through the ball bearing 16 is suppressed. As a result, if the parts of the heating roller 12 where the ball bearings 16 are located are configured to be relatively thin as in the sheet passing area of the fixing roller 12, the rising time of the fixing roller 12 to a fixing temperature is decreased, and at the same time a decrease in the fixing temperature is prevented, so that inferior fixing is avoided.

Further, because the rib 17 is provided at the parts of the fixing roller 12 where the ball bearings 16 are located, crushing of the fixing roller 12 at the parts thereof where the ball bearings 16 are located due to bending thereof is prevented. The ribs 17 have the same configuration as that of the ribs 15, 15' provided at the sheet passing area of the fixing roller 12. Therefore, at the parts of the fixing roller 12 where the ball bearings 16 are located, the ribs 17 never abnormally increase the force of sandwiching a recording sheet with the fixing roller 12 and the pressing roller 13 as compared to the sheet passing area of the fixing roller 12, and thus such a phenomenon never occurs in which the recording sheet is sandwiched and conveyed between the fixing roller 12 and the pressing roller 13 is pulled at both end parts of the recording sheet in a widthwise direction thereof. Consequently, occurrence of wrinkling in the recording sheet is suppressed.

If the fixing roller 12 were configured so as to have a thinner wall thickness at the part of the fixing roller 12 where the ball bearings 16 are located and if the ribs 17 were not provided at those parts, the fixing roller 12 would easily be crushed at those parts under the influence of increased contacting pressure from the pressing roller 13, and as a result, the surface area of the fixing roller 12 contacting the circumferential surface of the pressing roller 13 would increase at the part of the fixing roller 12 where crushed, i.e., the part where the ball bearings 16 are located, so that a recording sheet would be pulled at both widthwise end parts thereof, and thereby the recording sheet would tend to be wrinkled. To avoid this, the number of ribs provided at the sheet passing area of the fixing roller 12 can be increased at the both axial end parts of the sheet passing area of the fixing roller 12, which however is not desirable from the view point of processing cost of the fixing roller 12.

When the number of ribs at the sheet passing area of the fixing roller 12 is reduced to a level of 3–7 as described above, it is conceivable to extend both end parts of the fixing roller 12, which have a wall thickness greater than that of the sheet passing area of the fixing roller 12, toward the parts of the fixing roller 12 where the ball bearings 16 are located, so that the fixing roller 12 is prevented from being crushed at those parts of the fixing roller 12 where the ball bearings 16 are located. However, if the parts of the fixing roller 12 having the wall thickness greater than that of the sheet passing area of the fixing roller 12 extend to the parts of the fixing roller 12 where the ball bearings 16 are located, then as described above, a decrease in the fixing temperature is caused by heat dissipation through the ball bearings 16.

Accordingly, in this embodiment, the number of ribs at the sheet passing area of the fixing roller 12 can be set to be in the range of 3–7, and both end parts of the fixing roller 12 in the axial direction thereof, which have a wall thickness greater than that of the sheet passing area of the fixing roller 12, are configured not to extend to the parts of the fixing roller 12 where the ball bearings 16 are located, and the ribs 17 having the same configuration as that of the ribs 15, 15', which are provided at the sheet passing area of the fixing roller 12, are provided at the parts of the fixing roller 12 where the ball bearings 16 are located. Thereby, crushing of the fixing roller 12 at the parts of the fixing roller 12 where the ball bearings 16 are located is avoided, and an excessive increase of the contacting area of the fixing roller 12 with the pressing roller 13 is avoided at both end parts of a recording sheet in its widthwise direction.

In the above embodiment, a fixing roller having a heating source inside thereof is used. However, a fixing roller which does not have a heating source inside thereof and which instead is heated by an external heat source can also be used.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Application No. 2000-331066 filed in the Japanese Patent Office on Oct. 30, 2000, and the entire contents of which are hereby incorporated herein by reference.

What is claimed is:

1. A fixing apparatus for fixing a toner image carried on a recording sheet onto the recording sheet with heat, comprising:

a fixing roller having a plurality of ribs formed at a sheet passing area of the fixing roller in an axial direction of the fixing roller to protrude from an internal circumferential surface of the fixing roller toward a cross-sectional center of the fixing roller, the plurality of ribs provided along the axial direction of the fixing roller such that a number of ribs per a unit length at a center part of the sheet passing area of the fixing roller in the axial direction of the fixing roller is different from that at other parts of the sheet passing area;

a heating source configured to heat the fixing roller; and a pressing roller configured to oppose and rotate with the fixing roller, wherein the toner image on the recording sheet is fixed onto the recording sheet while the recording sheet is being sandwiched and conveyed between the fixing roller and the pressing roller.

2. The fixing apparatus according to claim 1, wherein the heating source is provided inside of the fixing roller.

3. The fixing apparatus according to claim 1, wherein the number of ribs per a unit length is greater at the center part of the sheet passing area of the fixing roller in the axial direction of the fixing roller than at the other parts of the sheet passing area.

4. The fixing apparatus according to claim 1, wherein a center of the fixing roller in the axial direction of the fixing roller corresponds to a center of the sheet passing area of the fixing roller in the axial direction of the fixing roller.

5. The fixing apparatus according to claim 1, wherein the fixing roller has a first wall thickness at the sheet passing area and a second wall thickness at least at a part of axial end parts that are out of the sheet passing area, and wherein the second wall thickness is greater than the first wall thickness.

6. The fixing apparatus according to claim 5, further comprising:

a supporting member configured to oppose a supported part of the axial end parts of the fixing roller to support the fixing roller, wherein the supported part of the axial end parts of the fixing roller that the supporting member is configured to oppose does not have the second wall thickness.

7. The fixing apparatus according to claim 6, wherein a rib is formed at the supported part to protrude from the internal circumferential surface of the fixing roller toward the cross-sectional center of the fixing roller, and wherein, a height measured from the internal circumferential surface of the fixing roller, of the rib formed at the supported part to protrude from the internal circumferential surface of the fixing roller toward the cross-sectional center is different from that of the part of the axial end parts of the fixing roller having the second wall thickness.

8. The fixing apparatus according to claim 7, wherein the height measured from the internal circumferential surface of the fixing roller, of the rib formed at the supported part is equal to that of the plurality of ribs formed at the sheet passing area of the fixing roller.

9. An image forming apparatus, comprising:

an image forming unit configured to form a toner image on a recording sheet; and a fixing apparatus configured to fix the toner image on the recording sheet onto the recording sheet with heat, the fixing apparatus including, a fixing roller having a plurality of ribs formed at a sheet passing area of the fixing roller in an axial direction of the fixing roller to protrude from an internal circumferential surface of the fixing roller toward a cross-sectional center of the fixing roller, the plurality of ribs provided along the axial direction of the fixing roller such that a number of ribs per a unit length at a center part of the sheet passing area of the fixing roller in the axial direction of the fixing roller is different from that at other parts of the sheet passing area;

a heating source configured to heat the fixing roller; and a pressing roller configured to oppose and rotate with the fixing roller, wherein the toner image on the recording sheet is fixed onto the recording sheet while the recording sheet is being sandwiched and conveyed between the fixing roller and the pressing roller.

10. The image forming apparatus according to claim 9, wherein the heating source is provided inside of the fixing roller.

11. The image forming apparatus according to claim 9, wherein the number of ribs per a unit length is greater at the center part of the sheet passing area of the heating roller than at the other parts of the sheet passing area.

12. The image forming apparatus according to claim 9, wherein a center of the fixing roller in the axial direction of the fixing roller corresponds to a center of the sheet passing area of the fixing roller in the axial direction of the fixing roller.

13. The image forming apparatus according to claim 9, wherein the fixing roller has a first wall thickness at the sheet passing area and a second wall thickness at least at a part of axial end parts that are out of the sheet passing area, and wherein the second wall thickness is greater than the first wall thickness.

14. The image forming apparatus according to claim 13, the fixing apparatus further comprising, a supporting member configured to oppose a supported part of the axial end parts of the fixing roller to support the fixing roller, wherein the supported part of the axial end parts of the fixing roller that the fixing roller supporting member is configured to oppose does not have the second wall thickness.

15. The image forming apparatus according to claim 14, wherein a rib is formed at the supported part to protrude from the internal circumferential surface of the fixing roller toward the cross-sectional center of the fixing roller, and wherein a height, measured from the internal circumferential surface of the fixing roller, of the rib formed at the supported part to protrude from the internal circumferential surface of the fixing roller toward the cross-sectional center is different from that of the part of the axial end parts of the fixing roller having the second wall thickness.

16. The image forming apparatus according to claim 15, wherein the height, measured from the internal circumferential surface of the fixing roller, of the rib formed at the supported part is equal to that of the plurality of ribs formed at the sheet passing area of the fixing roller.

17. A fixing roller for use in a fixing apparatus for fixing a toner image carried on a recording sheet onto the recording sheet with heat, comprising:

a plurality of ribs formed at a sheet passing area of the fixing roller in an axial direction of the fixing roller to protrude from an internal circumferential surface of the fixing roller toward a cross-sectional center of the fixing roller, the plurality of ribs provided along the axial direction of the fixing roller such that a number of ribs per a unit length at a center part of the sheet passing area of the fixing roller in the axial direction of the fixing roller is different from that at other parts of the sheet passing area; and a heating source provided configured to heat the fixing roller.

18. The fixing roller according to claim 17, wherein the number of ribs per a unit length is greater at the center part of the sheet passing area of the fixing roller than at the other parts of the sheet passing area.

19. The fixing roller according to claim 17, wherein a center of the fixing roller in the axial direction of the fixing roller corresponds to a center of the sheet passing area of the fixing roller in the axial direction of the fixing roller.

20. The fixing roller according to claim 17, wherein the fixing roller has a first wall thickness at the sheet passing area and a second wall thickness at least at a part of axial end parts that are out of the sheet passing area, and wherein the second wall thickness is greater than the first wall thickness.

21. The fixing roller according to claim 20, wherein a supported part of the axial end parts of the fixing roller that a supporting member for supporting the fixing roller is configured to oppose does not have the second wall thickness.

22. The fixing roller according to claim 21, wherein a rib is formed at the supported part to protrude from the internal circumferential surface of the fixing roller toward the cross-sectional center of the fixing roller, and wherein a height, measured from the internal circumferential surface of the fixing roller, of the rib formed at the supported part to protrude from the internal circumferential surface of the fixing roller toward the cross-sectional center is different from that of the part of the axial end parts of the fixing roller having the second wall thickness.

23. The fixing roller according to claim 22, wherein the height, measured from the internal circumferential surface of the fixing roller, of the rib formed at the supported part that is equal to that of the plurality of ribs formed at the sheet passing area of the fixing roller.

24. A fixing apparatus for fixing a toner image carried on a recording sheet onto the recording sheet with heat, comprising:

a fixing roller having a plurality of ribs formed at a part of the fixing roller so as to protrude from an internal surface of the fixing roller, the plurality of ribs being provided along an axial direction of the fixing roller such that an interval of the plurality of ribs increases toward respective axial ends of the fixing roller from a center of the part of the fixing roller where the plurality of ribs are formed in the axial direction of the fixing roller;

a heating source configured to heat the fixing roller; and a pressing roller configured to oppose and rotate with the fixing roller, wherein the toner image on the recording sheet is fixed onto the recording sheet while the recording sheet is being sandwiched and conveyed between the fixing roller and the pressing roller.

25. The fixing apparatus according to claim 24, wherein the fixing roller has a first wall thickness at the part of the fixing roller where the plurality of ribs are formed and a second wall thickness at axial end parts of the fixing roller, and wherein the second wall thickness is greater than the first wall thickness.

26. An image forming apparatus, comprising:

an image forming unit configured to form a toner image on a recording sheet; and a fixing apparatus configured to fix the toner image on the recording sheet onto the recording sheet with heat, the fixing apparatus comprising, a fixing roller having a plurality of ribs formed at a part of the fixing roller so as to protrude from an internal surface of the fixing roller, the plurality of ribs being provided along an axial direction of the fixing roller such that an interval of the plurality of ribs increases toward respective ends of the fixing roller from a center of the part of the fixing roller where the plurality of ribs are formed in the axial direction of the fixing roller;

a heating source configured to heat the fixing roller; and a pressing roller configured to oppose and rotate with the fixing roller, wherein the toner image on the recording sheet is fixed onto the recording sheet while the recording sheet is being sandwiched and conveyed between the fixing roller and the pressing roller.

27. The image forming apparatus according to claim 26, wherein the fixing roller has a first wall thickness at the part of the fixing roller where the plurality of ribs are formed and a second wall thickness at axial end parts of the fixing roller, and wherein the second wall thickness is greater than the first wall thickness.

28. A fixing roller for use in a fixing apparatus for fixing a toner image carried on a recording sheet onto the recording sheet with heat, comprising:

a plurality of ribs formed at a part of the fixing roller so as to protrude from an internal surface of the fixing roller, the plurality of ribs being provided along an axial direction of the fixing roller such that an interval of the plurality of ribs increases toward respective ends of the fixing roller from a center of the part of the fixing roller where the plurality of ribs are formed in the axial direction of the fixing roller; and a heating source configured to heat the fixing roller provided inside of the fixing roller.

* * * * *